United States Patent [19]

Stafford

[11] 4,143,991

[45] Mar. 13, 1979

[54] MINE ROOF SUPPORT SYSTEM

[76] Inventor: Frank Stafford, P.O. Box 67, Keyser, W. Va. 26726

[21] Appl. No.: 909,262

[22] Filed: May 24, 1978

[51] Int. Cl.[2] ..... E21D 15/44

[52] U.S. Cl. ..... 405/291

[58] Field of Search ..... 61/45 D; 299/31, 33; 248/357; 91/170 MP, 1

[56] References Cited

U.S. PATENT DOCUMENTS

| | | | |
|---|---|---|---|
| 2,795,935 | 6/1957 | Fitzgerald | 61/45 D |
| 2,795,936 | 6/1957 | Blower et al. | 61/45 D X |
| 3,534,560 | 10/1970 | Rieschel | 61/45 D |
| 3,854,295 | 12/1974 | Round | 61/45 D X |

FOREIGN PATENT DOCUMENTS

| | | | |
|---|---|---|---|
| 1168373 | 4/1964 | Fed. Rep. of Germany | 61/45 D |
| 2363487 | 3/1975 | Fed. Rep. of Germany | 61/45 D |

*Primary Examiner*—Dennis L. Taylor

*Attorney, Agent, or Firm*—Stanley J. Price, Jr.; John M. Adams

[57] ABSTRACT

The mine roof support system includes a plurality of truss members each having opposite end portions and are operable to be moved into and out of abutting relation with a mine roof by a plurality of prop members. Each prop member includes an upper end portion connected to a respective end of each truss so that a pair of prop members is associated with each truss member. Each prop member includes an extensible portion and a shoe which is adapted to support the prop member for slidable movement on the mine floor. Guide mechanisms connect the extensible portion and shoe of each prop member to prevent relative movement between the upper end of the prop member and the shoe. The truss members are stabilized by a stabilizer device, such as a stabilizer bar secured to and extending downwardly from the end of each truss member and connected to the extensible portion of each prop member. The stabilizer bar is yieldable so that the bending forces applied to the prop member by the truss member are relieved by bending of the stabilizer bar. The pair of prop members associated with each truss member are movable in a direction either toward or away from the mine face relative to the other pairs of prop members by telescoping devices that interconnect the tandemly positioned prop members adjacent the mine ribs. The telescoping devices are connected to adjacent prop members in a manner to relieve the bending stresses that telescoping devices are subjected to as the pairs of prop members are moved relative to an adjacent pair of prop members.

10 Claims, 6 Drawing Figures

MINE ROOF SUPPORT SYSTEM

BACKGROUND OF THE INVENTION

1. Field of the Invention

This invention relates to a mine roof support system and more particularly to a plurality of extensible prop members arranged in pairs with each pair being operable to support a horizontal truss member in engagement with the mine roof where the pairs of prop members are connected by telescoping devices to thereby provide a movable roof support system of a preselected length.

2. Description of the Prior Art

It is known in the practice of continuous mining to provide a temporary roof support above a mining machine, such as a continuous miner operating at the mine face so that roof support is provided for the continuous miner being operated between the mine face and the last section of the mine roof supported by conventional devices such as roof bolts, timbers or the like. The temporary roof support must be operable to continuously support the mine roof as the miner advances into the mine face. This permits uninterrupted operation of the miner without encountering delays in the dislodging operation necessitated by assemblying and disassemblying temporary roof supports.

As illustrated in U.S. Pat. 2,795,935, moving roof supports are known to protect the mining machine and the operator while maintaining a roof support as the mining machine advances the face. A plurality of units are tandemly positioned in the passageway and extend from the mine face to a preselected distance rearwardly therefrom. Each unit includes a pair of roof support engaging elements that extend transversely across the mine passageway. Extensible upright jack devices support the roof engaging support elements adjacent the opposite ends. Each pair of roof engaging support elements includes a forward and rearward roof engaging support element and the upright jack devices associated with each pair are connected by extensible devices to permit walking or relative advancement or retraction of one roof engaging support element relative to the other for each pair. Similar moving roof support devices are illustrated and described in U.S. Pat. Nos. 2,795,936 and 3,890,792.

With the moving roof supports of the type disclosed by the above patents, the various members of the roof support are continuously subjected to bending forces such as for example the telescoping devices which connect the lifting jacks for the roof engaging support elements as the upright jacks advance relative to one another. In addition, torsional forces imparted to the roof engaging support elements subject the upright jacks to bending forces which may render the upwright jacks inoperable to maintain the roof engaging support elements in contact with the mine roof. There is need for a mine roof support system adaptable to provide roof support adjacent the mine face and as material is continuously dislodged from the mine face in which the roof support system is operable to advance at the rate of the dislodging operation.

SUMMARY OF THE INVENTION

In accordance with the present invention there is provided a mine roof support system that includes a plurality of truss members each having first and second end portions. The truss members are positioned in spaced parallel relation and are adapted to be positioned across the roof and abutting a mine roof. A plurality of prop members are provided and each has an upper end portion, an extensible portion and a shoe. The shoe is adapted to support the respective prop member for slidable movement on a mine floor. One of the prop members is positioned under the end of each truss member so that a pair of prop members is associated with each of the truss members. The prop member upper end portion is connected to the respective truss member. The prop members at the first end portions of the truss members form a first set of prop members. The prop members at the second end portions of the truss members form a second set of prop members. The prop members of the first set are positioned in spaced tandem relation and the prop members of the second set are positioned in spaced tandem relation. Telescoping mechanisms for connecting adjacent prop members of the first set and adjacent prop members of the second set are operable to permit movement of one pair of prop members relative to the other pairs of prop members. Stabilizer devices extend between each truss member and the upper end portion of each prop member and are operable to stabilize the truss member relative to the prop member.

Guide devices are connected to and extend between the extensible portion of each prop member and the shoe thereof. The guide devices are operable to prevent relative rotation between the extensible portion and the shoe of each prop member. Preferably, each guide device includes a first tubular member connected to the prop member extensible portion with the vertical bore extending through the tubular member. A second tubular member is connected to the shoe and includes a vertical bore extending therethrough where the vertical bores of the first and second tubular members are vertically aligned. A guide bar is positioned in the aligned bores of the first and second tubular members. The guide bar includes a lower end portion positioned in the second tubular member and suitably connected thereto. The second end portion of the guide bar is positioned for vertical movement in the bore of the first tubular member. With this arrangement as the extensible portion of the prop member is operable upon actuation to raise and lower the respective truss member, the first tubular member moves upwardly and downwardly on the guide bar. By connecting the prop member extensible portion with the shoe, angular movement of the upper end portion and the extensible portion of the prop member is transmitted through the guide bar to the shoe so that the shoe at the lower end of the prop member remains in the same angular relation with the upper end of the prop member. For example, in the event a torsional force should be applied to the upper end portion of the prop member, the angular movement imparted to the upper end portion would be transmitted by the guide bar to the shoe so that the shoe and upper end portion move or rotate together. In this manner relative movement between the shoe and upper end portion are prevented.

In a preferred embodiment of the present invention, the extensible portion of the prop member includes a cylinder pivotally connected at its upper end portion to one end of the respective truss member. A piston rod extends from the opposite end of the cylinder and is arranged to extend and retract relative to the cylinder. The opposite end portion of the piston rod extends into a vertically extending tubular portion of the shoe and is secured thereto by a pin extending through the tubular portion of the shoe and the end portion of the piston rod. Extension and retraction of the piston rod is operable to raise and lower the truss member through a preselected height range, which may be increased by the addition of an extension member connecting the tubular portion of the shoe with the end of the piston rod.

With the first tubular member of the guide device connected to the cylinder of the extensible portion and the second tubular member connected to the tubular portion of the shoe, rotation of the cylinder is transmitted by the guide bar positioned in the aligned bores of the respective tubular members to the shoe so that the shoe rotates on the mine floor as the cylinder rotates.

Preferably, the stabilizer device of the present invention includes a sleeve member connected to the end portion of each truss member with a longitudinal bore extending through the sleeve member where the sleeve is positioned on the truss member so that the bore extends vertically. A third tubular member is connected to the cylinder of the extensible portion and includes a longitudinal bore extending through the tubular member. The longitudinal bore of the tubular member is aligned with the bore of the sleeve. A stabilizer rod is positioned in the aligned bores of the sleeve and the third tubular member. An upper end portion of the stabilizer rod is secured to the sleeve and a lower end portion of the rod is movable within the bore of the third tubular member. With this arrangement, the stabilizer rod being connected through the sleeve to the truss member is free to move upwardly and downwardly within the bore of the third tubular member upon upward and downward movement of the truss member. The rod serves to stabilize the truss member on the prop member so that the truss members remain in spaced relation in a mine passage and at right angles to the prop members. The stabilizer rods are yieldable along the length of each rod between the adjacent ends of the sleeves secured to the truss member and the third tubular member secured to the cylinder. The stabilizer rods function as torsion bars so that when a torsional force is transmitted to the upper end portion of the prop member from the truss member or from the prop member to the truss member, the portion of a rod between the sleeve and the third tubular member flexes or bends to absorb the torsional forces imparted to the upper end portion of the prop member and/or the truss member and thereby prevent a failure in the connection between the upper end portion of the prop member and the truss member.

In the preferred operation of the present invention, the first and second set of prop members are positioned adjacent the sidewalls or ribs formed by the mine passageway to permit maneuvering of the machine used in the mining operation between the first and second set of prop members and under the truss members which are supported by the prop members in engagement with the mine roof. More desirably, a plurality of pairs of prop members and associated truss members may extend from adjacent the mine face rearwardly to a section of the mine roof which is supported by conventional roof bolts for operation of a continuous mining machine at the face and under the overhead protection provided by the truss members. As the mining machine advances forwardly during the dislodging operation, each pair of prop members and the associated truss member is advanced forwardly relative to the other prop members and truss members by operation of the telescoping mechanisms which are preferably hydraulic jack devices connecting the adjacent prop members of the first and second set of prop members. With this arrangement, the roof support system of the present invention is operable to advance with the mining machine as it advances forwardly by dislodging material from the mine face. Thus, the section of the mine roof between the mine face and the section of bolted roof closest to the mine face is supported by the truss members extending substantially the width of the mine passageway between the ribs.

A hydraulic control system of the roof support system permits each pair of prop members and the associated truss member to be raised and lowered and advanced and retracted individually relative to the other pairs of prop members and associated truss members.

Accordingly, the principal object of the present invention is to provide a mine roof support system that is operable to provide a roof support adjacent the mine face as the dislodging operation is conducted at the face and is operable to advance at the rate material is dislodged from the face and maintain a roof support during the advancement.

Another object of the present invention is to provide a movable roof support system including a plurality of pairs of prop members for supporting truss members in engagement with the mine roof where the truss members are stabilized on the respective pair of prop members by stabilizing devices.

A further object of the present invention is to provide a plurality of pairs of prop members arranged to raise and lower the truss members into engagement with the mine roof to provide a tandem arrangement of truss members extending from the mine face to the bolted section of the mine roof and the prop members are interconnected along the length of the roof support system by telescoping mechanisms which permit relative movement between the respective pairs of prop members to advance the roof support system as the mining machine forwardly advances.

These and other objects of the present invention will be more completely described in the following specification, the accompanying drawings and the appended claims.

DESCRIPTION OF THE PREFERRED EMBODIMENT

Figure 1:
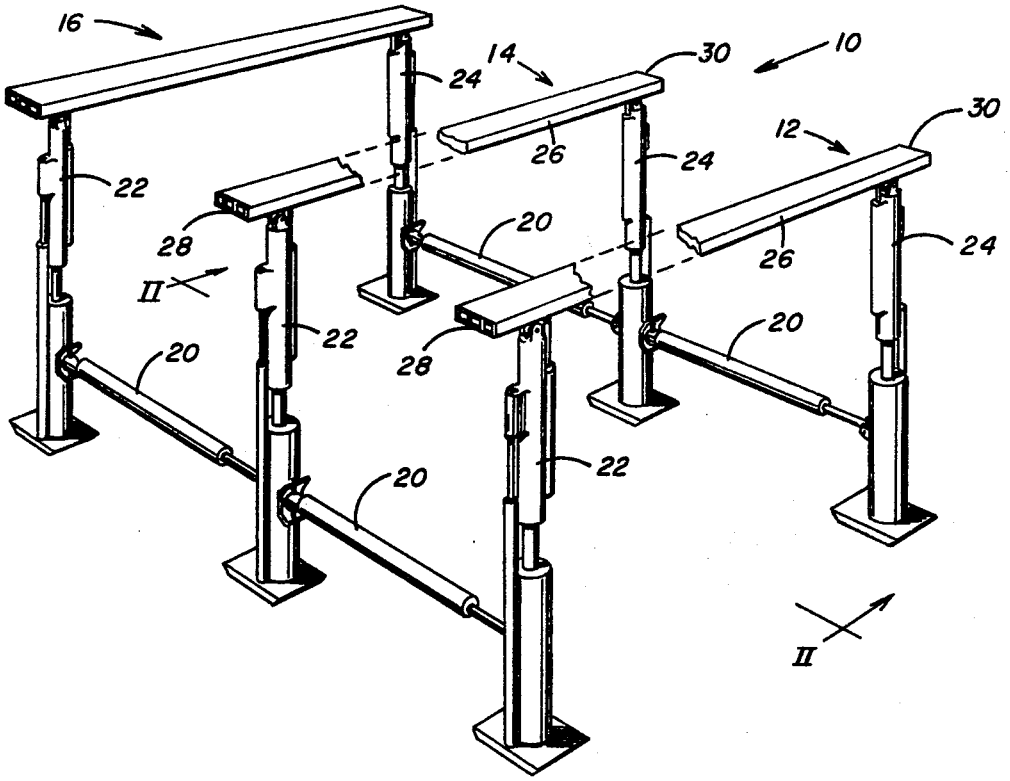
FIG. 1 is a perspective view of the mine roof support system of the present invention, illustrating a plurality of horizontally extending truss members positioned in spaced tandem relation and supported by pairs of extensible prop members that are interconnected by telescoping jacks for individually advancing the truss members.
Figure 2:
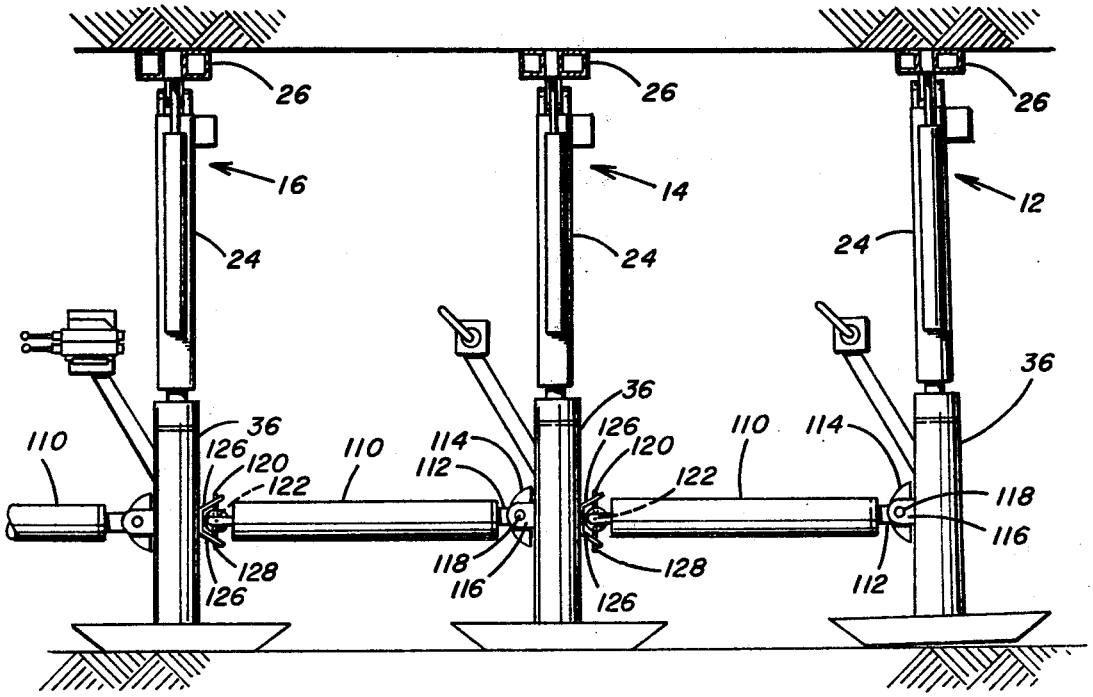
FIG. 2 is a view in side elevation of one side of the roof support system taken along the inner side of the prop members.
Figure 3:
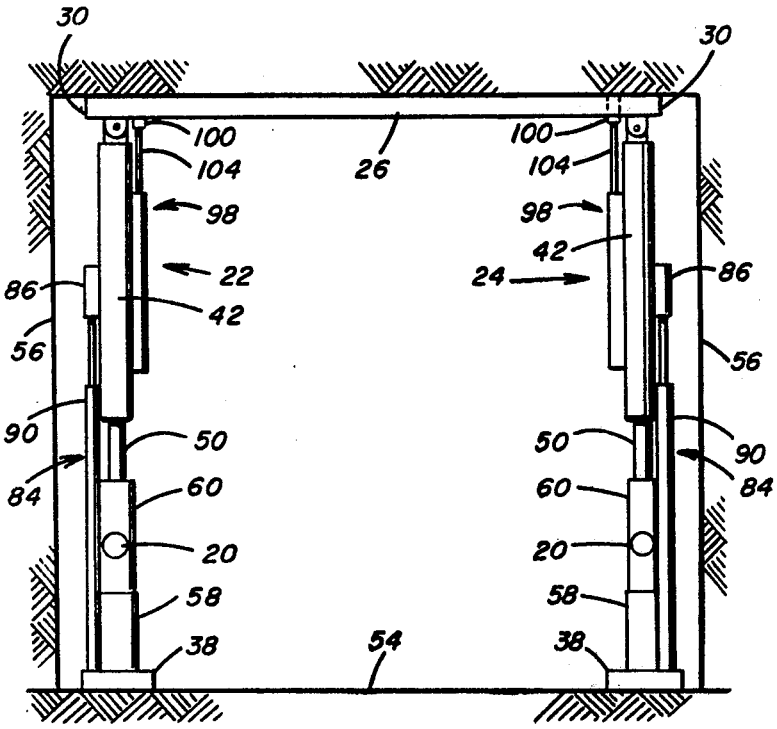
FIG. 3 is a view in front elevation of the roof support system positioned in the passageway of a mine, illustrating a pair of prop members positioned adjacent the mine ribs and supporting a truss member in engagement with the mine roof to thereby support the section of the mine roof above the respective truss member.

Referring to the drawings and more particularly FIGS. 1-3, there is illustrated a mine roof support system generally designated by the numeral 10 that includes a plurality of movable roof supports, generally designated by the numerals 12, 14 and 16 that are interconnected by telescoping mechanisms, such as hydraulically operated rams or jacks 20. Opposite pairs of the rams 20 are operable in unison in accordance with the hydraulic circuit illustrated in FIG. 5 to effect advancement either forward or backward of each roof support independent of the other roof supports to facilitate moving the entire mine roof support system in a mine. It should be understood that any number of individual roof supports of which three are illustrated in FIG. 1, may be interconnected by the rams 20 to provide continuous roof support between the area adjacent the mine face and the last section in the mine passage that is supported by conventional roof support devices such as roof bolts inserted in the mine roof. With this arrangement, a flexible mine roof support system is provided in which movable roof supports may be efficiently added or removed from the roof support system, in a manner which will be explained hereinafter in greater detail.

Each movable roof support 12–16 includes a pair of extensible prop members 22 and 24 and a horizontal truss member 26 having end portions 28 and 30 connected to and supported by the prop members 22 and 24. As illustrated in detail in FIG. 4, each prop member of the pairs of prop members that comprise the roof supports 12–16 includes an upper end portion 32, an extensible portion 34 and a base portion 36, in which the base portion 36 includes a shoe 38 adapted for slidable movement on the mine floor and an upwardly extending tubular portion 40 connected to the extensible portion 34. With this arrangement, each pair of prop members 22 and 24 is operable to raise and lower the respective truss member 26 into and out of engagement with the mine roof in advance relation to the other pairs of prop members when the respective truss member is lowered from engagement with the mine roof by sliding of the shoes 38 on the mine floor, in a manner to be explained later in greater detail.

As illustrated in FIG. 3, each truss member 26 extends a considerable distance so that the prop members 22 and 24 beneath each end of the truss member 26 is positioned closely adjacent the respective sidewalls or ribs formed by the mine passageway. With this arrangement the prop members 22 and 24 are spaced a sufficient distance to permit maneuvering of machinery in the passageway beneath the truss members 26 and between the pairs of prop members 22 and 24. Specifically, the roof supports are adapted to the operation of a mining machine, such as a continuous miner at the mine face and provide roof support above the miner during the dislodging operation. The continuous miner is maneuverable between the prop members to advance into the mine face and retract therefrom and move rearwardly in the mine passageway.

As the continuous miner advances as it dislodges material from the face, the roof supports 12–16 are individually moved forwardly in the passageway with the continuous miner to provide uninterrupted roof support of the continuous miner operating at the mine face. Thus as the miner advances the entire roof support system periodically moves forward as the continuous miner advances. In addition, the roof support system may be retracted from the face and moved to another location. Also, the distance between the forward roof support 12 and the rearward roof support 16 may be varied to extend the roof support system a maximum distance or a minimum distance as determined by the extension of the rams 20.

Figure 4:
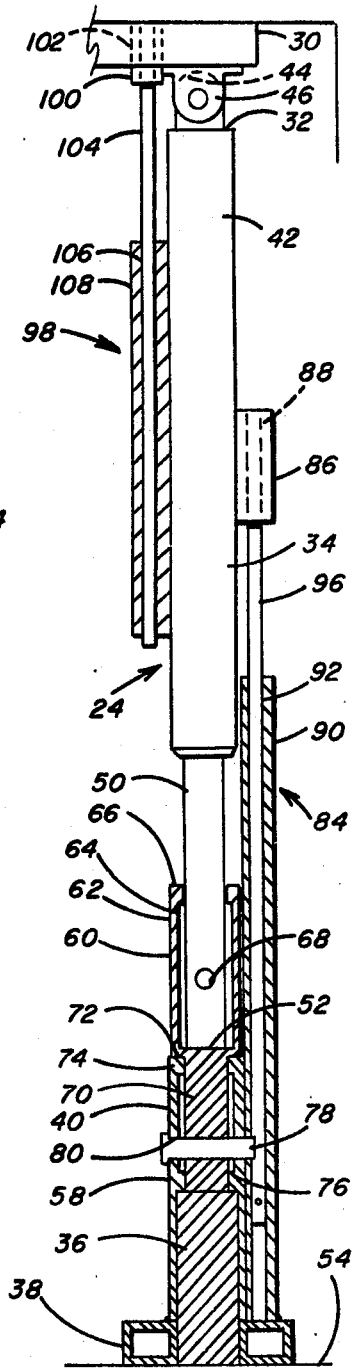
FIG. 4 is an enlarged fragmentary view in front elevation of one end of a truss member and an extensible prop connected thereto for supporting the end of the truss member, illustrating a stabilizer device for the truss member and a guide device for preventing relative movement between the upper end of the prop member and the shoe of the prop member positioned on the mine floor.

Each of the prop members of the movable roof supports 12–16 includes the extensible portion 34, which is preferably a hydraulic piston cylinder assembly having, as illustrated in greater detail in FIG. 4, a cylinder portion 42 having an ear 44 extending from the upper end 32 in which the ear 44 has a bore extending therethrough. The bore is aligned with a pair of bores extending through spaced apart ears 46 that are secured to the end of each truss member. The ear 44 is positioned between ears 46 and a pin member extends through the aligned bores of the ears 44 and 46 to pivotally connect the cylinder portion 42 to the end of the respective truss 26. An extensible piston rod 50 is positioned in the bore of the cylinder portion 42 and includes an end portion 52 that is suitably connected to the base 36 of each prop member in a manner to facilitate efficient assembly and disassembly of the prop members in the mine passageway.

The base 36 of each prop member, as illustrated in FIG. 4, includes the shoe 38 which is adapted to engage and rest upon the mine floor 54 adjacent the mine rib 56. The shoe 38 is preferably formed with sloping end portions as with known skids or runners to facilitate slidable movement of the shoe on the mine floor upon actuation of the hydraulic rams 20. A tubular portion 58 is secured to and extends upwardly from the shoe 38 and includes a hollow cylinder arranged to receive the piston rod end portion 52. As illustrated in FIG. 4, an extension member 60 for connecting the piston rod lower end 52 to the shoe tubular portion 58 is provided to increase vertical height of the truss member 26. Preferably, the extension member 60 includes a tubular portion 62 having a vertical bore 64 adapted to receive the piston rod lower end 52. The upper portion of the tubular portion 62 has an inturned shoulder 66 positioned in surrounding relation with the piston rod 50. The piston rod lower end 52 abuts the base of the extension member 60 and is connected to the extension tubular portion 62 by means of a suitable pin 68 that passes through aligned bores and the piston rod lower end 52 and the extension member tubular portion 62. The extension member 60 includes a cylindrical base or lower end 70 of a diameter less than the outer diameter of the tubular portion 62. The cylindrical portion 70 is arranged to extend into the bore of the tubular portion 58 so that the shoulder 72 of the extension member 60 abuts the inturned shoulder 74 of the tubular portion 58. The tubular portion 58 may also include an inturned shoulder 76 adapted to be positioned in surrounding abutting relation with the lower end of the extension cylindrical portion 70 to thereby maintain the extension member 60 axially aligned with the tubular portion 68 of the base 36. A suitable pin 78 extends through aligned bores 80 and 82 of the tubular portion 58 and cylindrical portion 70 respectively to facilitate releasable engagement of the extension member 60 to the base 36. In the event the extension member 60 is not utilized to provide an increased elevation of the truss member 26, the piston rod lower end 52 is positioned in the bore of the tubular portion 58 so that the bore 80 of the tubular portion 58 is aligned with the bore thorugh the lower end 52 to receive the pin 78 and thereby connect the piston rod 50 to the base 36.

As further illustrated in FIG. 4, a guide mechanism generally designated by the numeral 84 is provided for each prop member to prevent relative rotative movement between the upper end 32 of the prop member and the shoe 38. In the event a rotary or twisting force is imparted to the prop upper end 32, the rotational or pivotal movement of the cylinder is transmitted by the guide mechanism 84 to the shoe 38 and the piston rod 50 and the shoe 38 pivots or rotates or moves the same amount on the mine floor 54. Preferably, the guide mechanism 84 includes a first sleeve or tubular member 86 with a cylindrical bore 88 suitably secured as by welding to the cylinder portion 42. Positioned in spaced underlying relation with the sleeve 86 is a tubular member or sleeve 90 that has a vertically extending bore 92. The elongated sleeve 90 is rigidly secured as by welding at its lower end portion to the shoe 38. An elongated guide bar 96 is slidably received within the bore 88 of sleeve 86 and extends into the bore 92 of sleeve 90. The guide bar 96 is secured in the bore 92 by a suitable set screw or the like. Thus, with this arrangement, upon angular movement of the cylinder portion 42, the sleeve 86 and the guide bar 96 positioned therein move with the cylinder portion 42. Angular movement of the guide bar 96 is transmitted through the sleeve 90 to the shoe 38 to move the shoe 38 through the same degree of angular movement as the cylinder portion 42.

The present invention also includes stabilizer means generally designated by the numeral 98 for each prop member of the movable roof supports 12–16 as illustrated in detail in FIG. 4. The stabilizer device 98 includes a sleeve 100 secured in a suitable manner to the end portion 30 of truss 26 and includes a bore 102 arranged to receive the upper end of a stabilizer bar 104. Suitable means such as a weld or a threaded connection secures the upper end of the stabilizer bar 104 in the sleeve 100. The lower end of the stabilizer bar 104 is slidably received within a vertically extending bore 106 of an elongated tubular member or sleeve 108 that is secured to the cylinder portion 42. With the upper end portion of the stabilizer bar secured to the truss member, relative vertical movement at the pin connection between the truss member and the prop member is transmitted to the stabilizer bar so that it can move a similar distance vertically within the sleeve bore 106. Preferably, the stabilizer bar 104 is a yieldable or resilient member permitting the section of the bar between sleeves 100 and 108 to bend and take up the torsional forces applied to the end portion 30 of the truss member 26. The pivotal connection of the end of the truss member to the cylinder portion 42 of the prop provides for pivotal movement between the truss member and the prop when a torsional force is applied to the end of the truss member. However, this torsional force is taken up by the stabilizer bar 104 so that the stabilizer bar 104 bends to a limited degree with the torsional force and returns to a straight condition when the torsional force is removed. This provides a generally resilient connection between the prop members and the truss members so that the roof support members may deviate slightly from a U-shaped rectangular configuration without breaking the connection between the prop members and the truss member. In addition, the rod 104 is operable to stabilize the truss member above the prop member so that the longitudinal axis of each truss member remains perpendicular to the vertically extending longitudinal axis of the prop member. This arrangement assures that the truss members of the entire roof support system 10 remain in spaced parallel tandem relation along the length of the roof support system to provide maximum roof support above the roof support system.

As illustrated in FIG. 1, the prop members 22 positioned at the adjacent ends of the truss members 26 are positioned in spaced tandem relation and form a first set of prop members that are arranged to be positioned adjacent one rib in the mine passage and the tandemly positioned prop members 24 adjacent the opposite rib in the mine passage form a second set of prop members where the prop members of each set are interconnected by the hydraulic rams 20. The hydraulic rams 20 are connected to adjacent pairs of prop members of each set in the manner as illustrated in FIG. 2 in which each ram includes a cylinder portion 110 and an extensible piston rod 112 movable into and out of the cylinder portion. The end portion of piston rod 112 is pivotally connected to the base 36 of a prop member; while, the cylinder portion 110 is pivotally connected to the base 36 of an adjacent prop member. The connection of the respective hydraulic ram to the adjacent prop members includes means for relieving the bending stresses on the rams. This is provided by the piston rod 112 having an enlarged end portion or foot 114 arranged to extend between the spaced ears 116 secured to the prop member base 36.

A suitable pin 118 passes through aligned openings in the spaced ears 116 and foot 114 and thereby hingedly connects the piston rod 112 to the respective prop member base 36. The end portion of the cylinder portion 110 includes a pivot support member 120 extending rearwardly from the end of the cylinder portion and having a transverse bore 122 extending therethrough. The pivot support member 120 is positioned between a pair of outwardly flared plate members or ears 126 that extend from the adjacent prop member base, and the outwardly flared ears 126 include openings which when aligned with the transverse bore 122 are arranged to receive a suitable pin 128. With this arrangement of connecting the cylinder portion to the adjacent prop member base, the cylinder portion is movable relative to the prop base member so that when bending stresses are applied to the respective rams 20 limited movement of the rams relative to the prop members is permitted to relieve the bending stresses applied to the rams and thereby prevent bending of the rams and breaking of the respective connections to the prop members.

Figure 5:
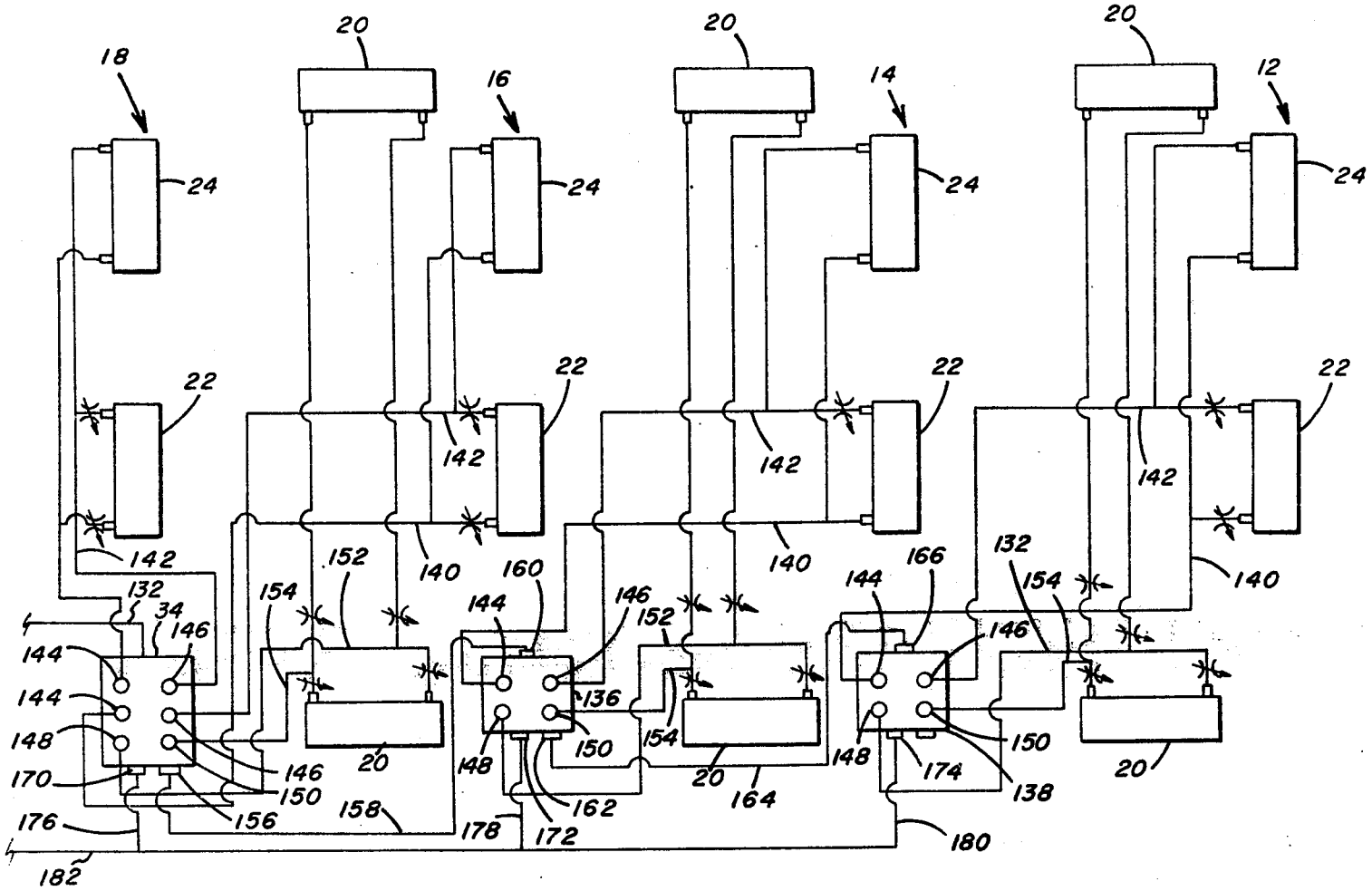
FIG. 5 is a hydraulic diagram, illustrating the control devices for operating the prop members that raise and lower the truss members and the telescoping jack members for walking the prop members associated with each truss member.

Hydraulic fluid under pressure is selectively supplied to the rams 20 and the prop members of each movable roof support 12–16 to advance and retract the roof support system 10 in the mine passage and raise and lower the truss members relative to the mine roof by operation of the hydraulic circuitry generally designated by the numeral 130 in FIG. 5. In FIG. 5, the hydraulic controls for four units is illustrated. Hydraulic fluid under pressure is provided from any suitable source, as for example, a mining machine, roof drill or the like through a conduit 132 to the inlet port of a multi-part valve 134 for operating the prop members 22 and 24 of the rearmost roof support designated by the numeral 18 positioned at the rear of the roof support system 12 away from the mine face. With this arrangement, operation of the valve 134 controls the actuation of the prop members of roof support 18 as well as the prop members of roof support 16. In a similar fashion, a multi-part valve 136 and a multi-part valve 138 control actuation of the prop members of the roof support 14 and 12 respectively. Each of the prop members of the respective roof supports is hydraulically connected to the respective valve by conduits 140 and 142. The respective prop members are extending and retracted by operation of suitable controls connecting the valve outlets 144 and 146 to the respective conduits 140 and 142 for flow of fluid in a first direction to the piston rod end of each prop to attract the piston rod 50 in the cylinder portion 42 and in a second direction to the cylinder end of the prop to extend the piston rod 50 from the cylinder portion 32. In a similar fashion, extension and retraction of the hydraulic rams 20 for moving the roof supports is accomplished by selectively supplying fluid under pressure from the valve outlets 148 and 150 of each valve through conduits 152 and 154 respectively in a first direction through the conduits 152 to the piston rod end of the rams 20 and in a second direction through conduits 154 to the cylinder end of the rams 20 to thereby retract and extend respectively the rams associated with the props of each support member. Thus with this arrangement, the prop members associated with each of the roof supports 12–18 and the rams associated with the props of each of the roof supports is hydraulically connected in parallel so that the corresponding prop members and rams of each roof support either to raise and lower the respective roof support or advance or retract the respective roof support are simultaneously actuated. This permits the roof supports to be individually raised or lowered, advanced or retracted as desired.

The valves 134–138 are hydraulically connected in series. Fluid under pressure is conveyed to the valve 134 by conduit 132 and from outlet 156 of valve 134 through conduit 158 to the inlet 160 of valve 136. Fluid from valve 136 is conveyed from outlet 162 thereof through conduit 164 to inlet 166 of valve 138. Thus, with this arrangement, a system is provided between the respective valves of the prop members between the valve box and the source of pressurized fluid.

For venting the respective prop members and rams of the roof supports each of the valves 134–138 includes an outlet 170, 172 and 174 respectively. The respective outlets are connected by conduits 176–180 to a common conduit 182 leading to the reservoir. Thus in operation each of the prop members and rams are double acting and particularly in the operation of the rams, an extension of one pair of rams, as for example, associated with the roof support 14 to advance the roof support 14 having the respective truss member disengaged from the mine roof results in retraction of the rams associated with the roof support 12 to permit the roof support 14 to move toward the roof support 12 and away from the roof support 16. Accordingly, in operation of the roof support system of the present invention, the roof support 14 closest to the mine face is advanced forwardly with the mine face followed by subsequent advance of the roof supports 14, 16 and 18. An important feature of the above arrangement is that the operation of the roof support system is protected by the extended roof support members, or the bolted roof as the roof support elements are advanced.

The advancement of a respective roof support requires that the respective truss member be lowered from engagement with the mine roof and therefore the section of the mine roof above the lowered truss member is unsupported. To ensure that the operator remains under a supported section of the mine roof, the controls for each support are positioned at the rearward adjacent roof support. For example, in order to operate the prop members of the roof support 12, the operator must position himself beneath the truss member of the roof support 14 which truss member remains in engagement with the mine roof. This prevents the operator from exposing himself to an unsupported section of the mine roof as a truss member is raised or lowered and the prop members advanced or retracted. In addition with the above described arrangement, it is not possible for the operator to actuate all of the roof supports from one position. This prevents simultaneously removing all the truss members of the roof support system from engagement wtih the mine roof and subsequently removing the entire roof support system from engagement with the mine roof.

Figure 6:
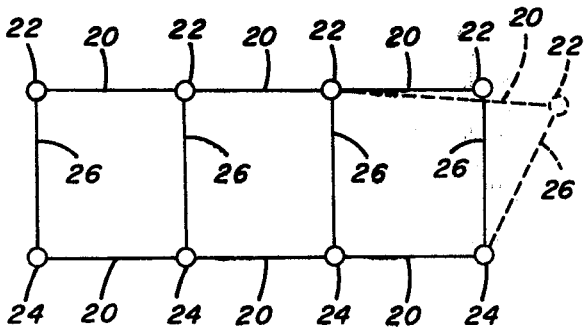
FIG. 6 is a schematic diagram of the manner in which the mine roof support system may be utilized to deviate from a straight line path.

FIG. 6 illustrates another feature of the roof support system. The universal connection between the ram members 20 and the respective prop members permits the roof support system to follow arcuate paths and move from one entry to another without dismantling the respective supporst and disconnecting the truss members from the prop members. It should be understood however, the pin type connections between the truss member and the connected props and between the props and the ram members permits rapid assembly and disassembly so that the entire system may be quickly disassembled and transported to another location in the mine.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A mine roof support system comprising, a plurality of truss members each having first and second end portions, said truss members being positioned in spaced relation and adapted to be positioned abutting a mine roof, a plurality of prop members each having an upper end portion, an extensible portion, and a base portion, said base portion being adapted to support said respective prop member for slidable movement on a mine floor, one of said prop members being positioned under each end of each truss member so that a pair of said prop members is associated with each of said truss members, said prop member upper end portion being connected to said respective truss member, said prop members at said first end portions of said truss members forming a first set of prop members, said prop members at said second end portions of said truss members forming a second set of prop members, said prop members of said first set being positioned in spaced tandem relation and said prop members of said second set being positioned in spaced tandem relation, telescoping means for connecting adjacent prop members of said first set and adjacent prop members of said second set to permit movement of one pair of said prop members relative to the other pairs of said prop members, and stabilizing means extending between each truss member and said upper end portion of each prop member for stabilizing said truss member above said prop member.

2. A mine roof support system as set forth in claim 1 which includes, guide means connected to and extending between each prop member and said base portion for maintaining said base portion aligned with said prop member upper end portion.

3. A mine roof support system as set forth in claim 1 which includes, connecting means for connecting said telescoping means to said prop members at each end of said truss members to permit movement of one prop member relative to another prop member.

4. A mine roof support system as set forth in claim 1 which includes, control means for individually raising and lowering said prop members associated with each truss member to raise and lower said respective truss member into and out of engagement with the mine roof.

5. A mine roof support system as set forth in claim 1 which includes, control means for individually extending and retracting said telescoping means to move said prop members at each end of said truss members.

6. A mine roof support system as set forth in claim 1 in which, said telescoping means includes extensible hydraulic jack devices each being positioned between said prop members at each end of said truss members, said extensible hydraulic jack devices each including a cylinder portion with an extensible piston rod positioned therein, said piston rod having an end portion pivotally connected to a respective prop member, means for supporting said piston rod end portion on said respective prop member to permit relative pivotal movement between said end portion of said piston rod and said respective prop member as said piston rod extends and retracts, said cylinder portion having an end portion with a pivot support member extending rearwardly therefrom and having a bore transverse to the longitudinal axis of said cylinder portion extending through said pivot support, a pair of plate members secured to said respective prop member adjacent said cylinder portion of each of said extensible hydraulic devices, said plate members being positioned in spaced relation and extending in a flared arrangement from said respective prop member, aligned bores extending through said plate members, said pivot support member bore being positioned in alignment with said aligned bores so that said pivot support member is positioned between said plate members, and pivot means extending through said aligned bores and said pivot support member bore for connecting said cylinder portion to said respective prop member to permit pivotal movement of said cylinder portion relative to the prop member upon extension and retraction of said piston rod.

7. A mine roof support system as set forth in claim 1 which includes, said shoe having a bearing surface adapted for slidable movement on the mine floor upon relative movement of each prop member, a leg portion extending upwardly from said bearing surface and having a vertical bore therein, said prop members each having an extensible rod portion with an end portion positioned in said vertical bore, and releasable pin means extending through said leg portion and said extensible rod portion for connecting said respective prop member to said shoe.

8. A mine roof support system as set forth in claim 1 which includes, extensible means for connecting each of said prop members to a respective shoe for increasing the height to which said respective truss member is operatively raised.

9. A mine roof support system as set forth in claim 1 in which a stabilizer means includes, a sleeve connected to each of said prop members adjacent said upper end thereof, said sleeve having a vertically extending bore, an elongated bar positioned for vertical movement in said sleeve bore, said elongated bar having an upper end spaced from said sleeve and secured to the end of said truss member above said sleeve, said bar being movable in said sleeve upon upward and downward movement of said truss member, and said elongated bar being operable to stabilize said respective truss member above said prop members.

10. A mine roof support system as set forth in claim 9 which includes, said elongated bar being yieldable between the connection thereof to said respective truss member and said sleeve to permit movement of said respective truss member relative to said prop members connected thereto.

* * * * *